United States Patent [19]

Brugman

[11] Patent Number: 4,648,703

[45] Date of Patent: Mar. 10, 1987

[54] DEVICE FOR EXPOSING AN EDGE ZONE OF A PHOTOCONDUCTIVE ELEMENT TO LIGHT

[75] Inventor: Wilhelmus T. J. Brugman, Venlo, Netherlands

[73] Assignee: Oce-Nederland B.V., Venlo, Netherlands

[21] Appl. No.: 783,940

[22] Filed: Oct. 3, 1985

[30] Foreign Application Priority Data

Oct. 10, 1984 [NL] Netherlands ..... 8403079

[51] Int. Cl.[4] ..... G03G 15/00

[52] U.S. Cl. ..... 355/3 R

[58] Field of Search ..... 355/3 R, 7, 14 E, 67

[56] References Cited

U.S. PATENT DOCUMENTS

| | | | |
|---|---|---|---|
| 3,724,940 | 4/1973 | Koizumi | 355/3 R |
| 3,788,737 | 1/1974 | Kidd | 355/3 R |
| 3,799,666 | 3/1974 | Fukushima et al. | 355/7 X |

OTHER PUBLICATIONS

*IBM Technical Disclosure Bulletin,* vol. 19, No. 5, Oct. 1976, Smart, J. W., "Photoconductor Erase", p. 1594.

*Primary Examiner*—Arthur T. Grimley
*Assistant Examiner*—J. Pendegrass
*Attorney, Agent, or Firm*—Reed Smith Shaw & McClay

[57] ABSTRACT

A device for exposing an edge zone of a photoconductive element to light comprising a light source and a moveable screen by means of which the width of the edge zone that is exposed to light can be adjusted. The light source is fixed to the moveable screen and is moveable therewith. Preferably, the screen consists of a pivotable housing in which the light source is mounted in an area defined by two planes which intersect along the bottom edge of the innermost side wall of the housing and form an angle of 15° such that the plane through the pivot line of the housing and the bottom edge of the innermost side wall of the housing bisects the 15° angle.

5 Claims, 2 Drawing Figures

DEVICE FOR EXPOSING AN EDGE ZONE OF A PHOTOCONDUCTIVE ELEMENT TO LIGHT

BACKGROUND OF THE INVENTION

1. Field of the Invention

The present invention relates to a device used in electrophotographic copiers for accurately exposing to light the edge zone of a photoconductive element to produce a clear, sharp margin on the edges of an image.

2. Description of the Prior Art

A typical device used in electrophotographic copiers for exposing an edge zone of a photoconductive element to light is described in U.S. Pat. No. 3,724,940. In this device, it is possible to set two or more different imaging ratios. The edge zone to be exposed to light can be adjusted for each imaging ratio. This device comprises a fixed light source and a pivotable light screen. By adjusting the pivotable light screen, the width of the edge zone required to be exposed to light can be varied for the different imaging ratios.

A disadvantage of this device is that a specific displacement of the light screen is not accompanied by a permanently fixed change in the dimensions of the edge zone required to be exposed. As a result, the operator must visually check that the light screen has been set to its correct position. To accomplish this, the copier in which this device is mounted is provided with a window through which the machine operator can check the width to which the edge zone has been adjusted by the movement of the light screen.

U.S. Pat. No. 3,901,593 describes an exposing device consisting of a box divided into two approximately equal parts by a light-tight wall. One part is for forming the top edge zone and the other part is for forming the side edge zones. One side of the one part has an aperture in the form of a long slit extending over the entire width of a photoconductive element, while the same side of the other part has two short slit apertures each extending over an edge zone of the photoconductive element. Shutter plates by means of which the size of the apertures can be varied are disposed in front of the short apertures. Mounted in the box behind the apertures are light sources. Also, light-scattering partitions are provided between the light sources and the short apertures. Apart from the fact that its construction is complicated, this device has the disadvantage that the shutters may jam or move stiffly due to fouling, making accurate adjustment impossible.

Similarly, U.S. Pat. No. 4,215,929 provides a very complicated device in which the image area is masked from exposure by overlapping polarized plates. By varying the overlapping area of the polarized plates, the width of the edge zones can be varied. Besides being very intricate and complicated, this device has the disadvantage that the polarizing plates must be moved in front of the control light in synchronization with the movement of the photosensitive element.

U.S. Pat. No. 3,799,666 discloses a permanently mounted shielding frame containing a light source which exposes the edges of an image to form a border. The disadvantage of this device is that the width of the edges cannot be varied. Moreover, this device can only be used with one image size. Similarly, U.S. Pat. No. 4,173,406 describes a device for exposing the edges of an image in which the size of the edges cannot be varied. If a different sized edge is desired, such as when the image magnification changes, an additional exposing device having its openings spaced to form the desired edge is required.

Thus, there is a need for an improved device for exposing the edge zones of photoconductive elements which overcomes the disadvantages mentioned above and which provides clear, sharp margins on the edges of an image.

SUMMARY OF THE INVENTION

Generally, the present invention provides a device comprising a light source and a moveable screen by means of which the width of the edge zone that is exposed to light can be adjusted and wherein the parts of the photoconductive element which are situated outside the edge zone are screened against exposure to light from the light source characterized in that the light source is fixed to the moveable screen and is moveable therewith.

In a preferred embodiment of the invention, the light source is mounted in a housing which, on its side facing the photoconductive element, is formed with an aperture in the form of a slit extending across an edge zone of the photoconductive element. The housing is pivotable in the direction of the length of the slit aperture. This embodiment provides a simple construction which, nevertheless, can be accurately adjusted by a relatively simple drive means. The result is a simple device which exposes to light all those parts of a photoconductive element which are situated outside an imaging section.

The invention and its advantages will be explained in detail with reference to the preferred embodiments and the drawings.

DESCRIPTION OF THE PREFERRED EMBODIMENTS

Figure 1:
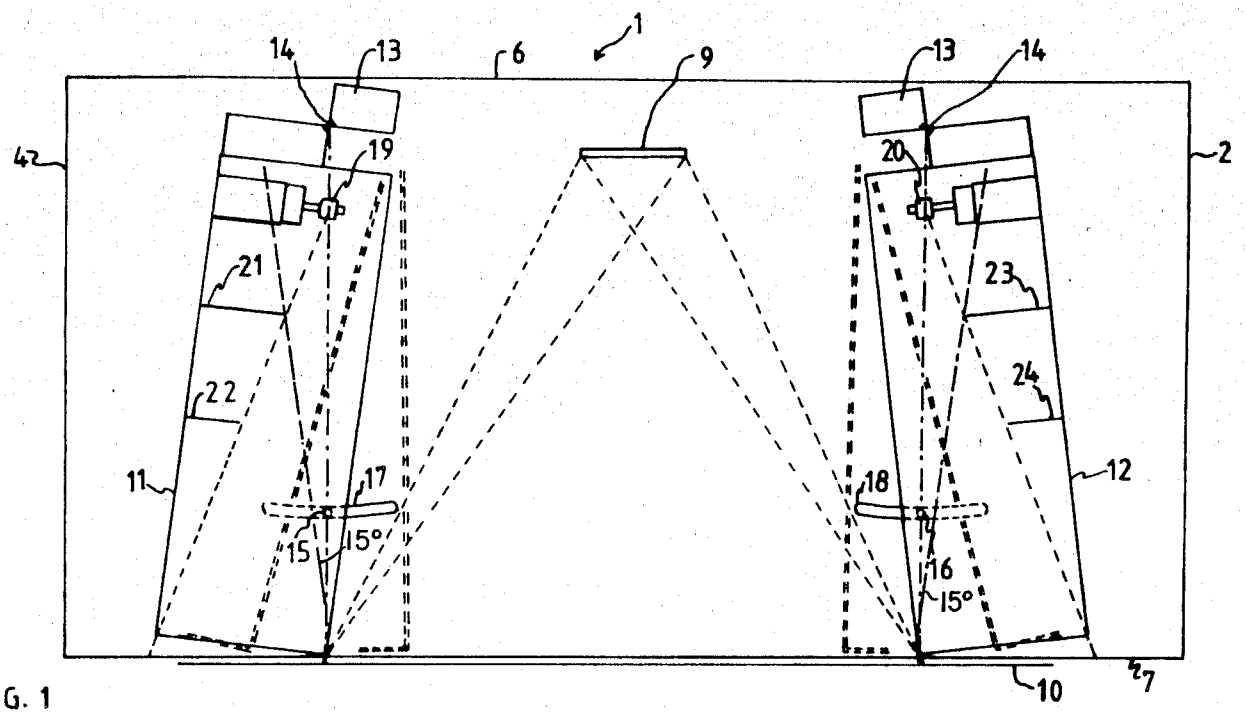
FIG. 1 is a schematic view of a device according to the invention.
Figure 2:
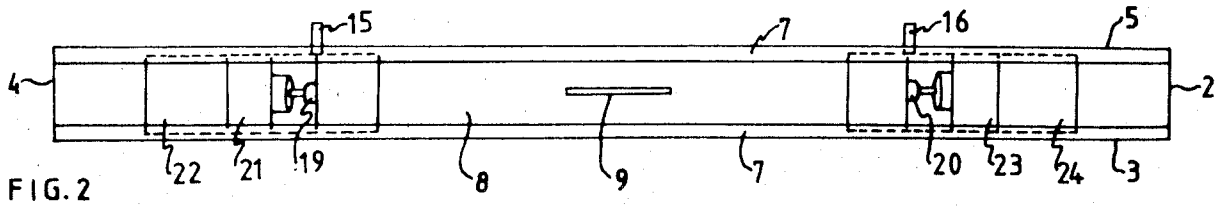
FIG. 2 is a view of the device shown in FIG. 1 as seen from the surface of the photoconductive element.

The device as shown in FIGS. 1 and 2 comprises a first housing 1 in the form of a rectangular box with light-tight side walls 2, 3, 4 and 5, a light-tight top wall 6 and a bottom wall 7 formed with an aperture 8 in the form of a slit. All the walls of housing 1 are covered on the inside with a material, such as a coat of matt black paint, which reflects no or substantially no light. A light source 9, such as a flash, is mounted in the middle of the housing and near top wall 6.

Housing 1 is suspended fixedly in a copying machine in such a manner that the bottom wall 7 extends across and just above a moving photoconductive element 10 of the copying machine. The distance between photoconductive element 10 and bottom wall 7 is such that the photoconductive element cannot touch the bottom wall and, thus, cannot be damaged. The distance between light source 9 and photoconductive element 10 in the preferred embodiment shown in FIG. 1 is approximately 260 mm.

Within housing 1, opposite each edge zone of the moveable photoconductive element, a housing 11 or a housing 12 is pivotally secured against the inside of one of the elongated side walls. In FIG. 1, both housings 11 and 12 are secured against side wall 5. The side walls and the top walls of housings 11 and 12, which are not numbered in FIGS. 1 and 2, consist of light-tight material and their inside is covered with a material which reflects no or substantially no light.

In a preferred embodiment, the pivotable fixing of housings 11 and 12 on a side wall is by means of a cross-spring pivot 13 which pivots about a line 14. It will be equally clear to those skilled in the art that other known pivoting fixings can be used. Housings 11 and 12 are open at the bottom and their opening overlaps slit aperture 8 in bottom wall 7 of housing 1.

The side wall of housing 11 or 12, respectively, situated opposite side wall 5 of the housing 1 is provided on the outside with a shaft end 15 or 16, respectively, such that said shaft end extends through slot 17 or 18, respectively and outside of housing 1. Slots 17 and 18 describe an arc of a circle, the center of which lies on pivot line 14. The end of the shaft 15 or 16, respectively, is connected to a drive means (not shown) which moves housing 11 or 12, respectively, in opposite directions. FIG. 1 shows the end positions of housings 11 and 12 in double broken lines.

Inside housings 11 and 12, respectively, light sources 19 and 20, respectively, are secured to one of the side walls of the housing at ample distance from slit aperture 8. Preferably, light sources 19 and 20 are incandescent lamps. Partitions 21 and 22 or 23 and 24, respectively, may be provided in housing 11 or 12, respectively, to prevent stray light from being emitted via the opening between the innermost side wall of housing 11 or 12, respectively, and photoconductive element 10.

When housing 11 or 12, respectively, is rotated about pivot line 14, light source 19 or 20, respectively, also moves. As a result of this joint movement, there is a substantially linear relationship between the horizontal displacement component of housing 11 or 12 (i.e. of shaft ends 15 and 16 connected to the drive means) and the change in the dimensions of the edge zones of photoconductive element 10 which are exposed by the light sources 19 and 20. Consequently, the initial positions of housings 11 and 12 are no longer important.

A purely linear relationship exists between the horizontal displacement component of housing 11 or 12, respectively, and the change in the width of the edge zone of photoconductive element 10 if the incandescent point of light source 19 or 20, respectively, is situated in the plane passing through pivot line 14 and the bottom edge of the innermost side wall of housing 11 or 12, respectively. The exact location of light source 19 or 20, however, is not critical. For example, in the situation shown in FIG. 1 where the shortest distance between the bottom edge of the innermost side wall of housing 11 or 12 and photoconductive element 10 is equal to 2 mm, light source 19 or 20 may be situated in an area defined by two planes which intersect along the bottom edge of the innermost side wall of housing 11 or 12 to form an angle of 15° such that the plane through pivot line 14 and the bottom edge of the innermost side wall of housing 11 or 12 bisects the 15° angle. The adjustment of the width of an edge zone can be made with a deviation of less than 0.2 mm. because of the linear relationship between the horizontal displacement component of housing 11 or 12 and the change in the width of the edge zone of photoconductive element 10.

The drive means for moving housing 11 or 12 may consist of any known drive means which insures that the housings are moved in opposite directions over equal distances. For example, shaft ends 15 and 16 may each be connected to a screw spindle provided with a left-hand and right-hand thread with equal pitch. Each screw spindle may, for example, be driven by a stepping motor.

The above-described preferred embodiment of the invention is adapted to expose to light all those zones of a moving photoconductive element which are situated outside an imaging section. The edge zones of photoconductive element 10 which are situated next to an imaging section are exposed to light by light sources 19 and 20. The width of the edge zones can be adjusted by rotating housing 11 or 12. The parts of the photoconductive element 10 situated between two consecutive imaging sections are exposed to light by both light sources 19 and 20 and flash 9. For this purpose, flash 9 is energized a number of times depending upon the distance between two consecutive imaging sections.

The control of the width of the edge zones required to be exposed to light can be carried out by a central control means of the copying machine which calculates the width of the zone by reference to input data concerning the size of the original to be copied, the imaging ratio set and the size of the copy material. The central control means can automatically control the housing drive means in order to bring housings 11 and 12 to the required positions. The control may be affected in such a way that the adjustment is always made to the smallest dimension, such as the dimension of the projected image or the dimension of the copy material.

It will be apparent to those skilled in the art that exposing an edge zone of a moving photoconductive element to light may be accomplished by an embodiment of this invention wherein housings 11 and 12 are slideable along a guide extending across the photoconductive element.

It will also be apparent that a device embodying the invention can be constructed which only exposes one edge zone of a moving photoconductive element to light. Similarly, it can be used separately from a means for exposing to light the parts of the photoconductive element situated between two consecutive imaging sections, or it can be used in combination with other known devices which expose those parts to light.

While presently preferred embodiments have been described in particularity with reference to the drawings, the invention may be otherwise embodied within the scope of the appended claims.

What is claimed is:

1. A device for exposing an edge zone of a photoconductive element to light comprising a housing and a light source mounted therein, the housing having on its side facing the photoconductive element an aperture in the form of a slit extending across an edge zone of the photoconductive element, and being pivotable in the direction of the length of the slit aperture such that the width of the edge zone that is exposed to light can be adjusted and wherein those parts of the photoconductive element which are situated outside the edge zone are screened against exposure to light from the light source, the light source being disposed in the housing in an area defined by two planes which intersect along the bottom edge of the innermost side wall of the housing and form an angle of 15° such that the plane through the pivot line of the housing and the bottom edge of the innermost side wall of the housing bisects the 15° angle.

2. A device as described in claim 1 wherein the light source is disposed in the plane through the pivot line of the housing and the bottom edge of the innermost side wall of the housing.

3. A device for exposing to light parts of a photoconductive element which are situated outside an imaging section comprising a first housing containing a light source and having on its side facing the photoconductive element an aperture in the form of a slit extending over the entire width of the photoconductive element, and one or more moveable means for exposing to light one or more edge zones of the photoconductive element wherein the moveable means comprises a second housing containing a light source and having an aperture in the form of a slit which overlaps the slit aperture of the first housing in an edge zone, the second housing being pivotable in the direction of the length of the slit aperture of the first housing to control the width of the overlap in the edge zone.

4. A device as described in claim 3 wherein the light source is disposed in the second housing in an area defined by two planes which intersect along the bottom edge of the innermost side wall of the second housing and form an angle of 15° such that the plane through the pivot line of the second housing and the bottom edge of the innermost side wall of the second housing bisects the 15° angle.

5. A device as described in claim 4 wherein the light source is disposed in the plane through the pivot line of the second housing and the bottom edge of the innermost side wall of the second housing.

* * * * *